United States Patent [19]

DuBois

[11] Patent Number: 4,731,253

[45] Date of Patent: Mar. 15, 1988

[54] WEAR RESISTANT COATING AND PROCESS

[75] Inventor: Samuel C. DuBois, Britton, Mich.

[73] Assignee: Wall Colmonoy Corporation, Madison Heights, Mich.

[21] Appl. No.: 46,438

[22] Filed: May 4, 1987

[51] Int. Cl.[4] ..... B05D 1/08

[52] U.S. Cl. ..... 427/34; 427/423; 420/453; 428/680

[58] Field of Search ..... 423/34, 423; 428/680; 420/453

[56] References Cited

U.S. PATENT DOCUMENTS

| | | | |
|---|---|---|---|
| 3,914,573 | 10/1975 | Muehlberger | 219/121 PL |
| 4,136,230 | 1/1979 | Patel | 428/680 |
| 4,228,223 | 10/1980 | Knotek et al. | 428/558 |

*Primary Examiner*—John H. Newsome
*Attorney, Agent, or Firm*—Harness, Dickey & Pierce

[57] ABSTRACT

A composite article comprising a metallic substrate having an improved ductile wear and corrosion resistant surface coating thereon and metallurgically bonded thereto in which the coating comprises a nickel-chromium-tungsten base alloy matrix having uniformly dispersed therethrough a plurality of primary wear resistant particles such as tungsten carbide, for example, and secondary chromium and/or tungsten carbide crystals. The invention further encompasses the method of making the composite article by applying a particulated mixture of the metal alloy and primary wear resistant particles preferably by the Plasma Transferred Arc technique on the surface of a metallic substrate.

15 Claims, 2 Drawing Figures

WEAR RESISTANT COATING AND PROCESS

BACKGROUND OF THE INVENTION

The present invention broadly relates to an article having an improved wear resistant and corrosion resistant coating thereon as well as the method of forming such composite article and more particularly, to an improved composite article and process of making the article by which a ductile wear and corrosion resistant nickel-chromium-tungsten base alloy matrix is applied having uniformly dispersed therethrough a plurality of primary wear resistant particles in further combination with secondary chromium and/or tungsten carbide crystals.

A variety of wear and corrosion resistant surface coatings have heretofore been used or proposed for use in a variety of applications where a wear resistant coating on a substrate is desired. Such wear resistant coatings of the types previously known are generally of a very hard and brittle structure rendering them susceptible to stress cracking during application and subsequent service. Such prior art wear resistant coatings are further characterized as generally lacking uniformity in the distribution of wear resistant particles such as tungsten carbide particles, for example, such that the final coating is of a gradient composition resulting in different wear resistant characteristics at different levels of the coating. This has resulted in variable wear rates of the coating as a result of the necessity of machining the coating as applied to proper dimensional tolerances as well as a progressive wear of the coating during service of the article.

The present invention overcomes many of the problems and disadvantages associated with wear and corrosion resistant coatings of the types heretofore known by providing a coating composition and process for applying the coating to a metallic substrate producing a metallurgically bonded coating which is of a tough and ductile characteristic and which further possesses excellent wear and corrosion resistant properties. The coating of the present invention is further characterized by a relatively uniform distribution of the wear resistant particles through the alloy matrix providing for uniform wear resistance as the coating wears during service and is further relatively devoid of any stress cracks. The coating accordingly, is particularly applicable for applying a ductile wear and corrosion resistant coating on the surfaces of extrusion screws for extruding plastics of various types as well as a variety of alternative wear resistant applications in which a ductile wear resistant coating is desired.

SUMMARY OF THE INVENTION

The benefits and advantages of the present invention are achieved in accordance with the process aspects thereof, by forming a particulated mixture of prealloyed nickel-chromium-tungsten base alloy particles of a controlled composition and size and primary wear resistant particles such as tungsten carbide, for example, of a controlled particle size range which are applied to a metallic substrate preferably by the Plasma Transferred Arc (PTA) technique effecting a heating of the alloy particles to a temperature above their melting point by introduction into an electric ion plasma arc of a temperature generally ranging from about 15,000° up to about 25,000° F. The molten weld pool is relatively viscous such that the primary wear resistant particles are retained in substantially uniform distribution without any tendency of settling during the solidification of the coating. The coating is preferably applied in two passes producing a double layer with the outer layer being relatively devoid of elements of the metallic substrate being coated as a result of co-melting and diffusion. During solidification of the weld pool, a secondary formation of chromium and/or tungsten carbide crystals occurs which precipitate and become distributed in the resultant solidified coating further enhancing the ductility and wear resistance thereof. The coating is further characterized by its excellent resistance to corrosive attack in view of the high nickel-chromium-tungsten alloy matrix.

The powder mixture applied by the Plasma Transferred Arc technique comprises about 40% to about 85% by weight of prealloyed particles containing from about 0.5 to about 1.7% by weight carbon; about 22 up to about 36% by weight chromium; from about 0.5 to about 2% by weight boron; from about 1 to about 2.8% by weight silicon; up tp maximum of about 5% by weight iron; from about 3 to about 14% by weight tungsten; up to maximum of about 2% by weight cobalt; up to a maximum of about 2% by weight of conventional residuals and impurities and with the balance of about 36.5 up to about 73% by weight being nickel. The powder mixture further includes from about 15 up to about 60% by weight based on the total powder mixture of primary wear resistant particles such as tungsten carbide, chromium boride, chromium carbide, titanium carbide, and the like.

The powder mixture after application to the metallic substrate is of substantially the same nominal composition as the powder mixture as applied with allowance for some melting and interdiffusion of the base metal into the first pass coating layer and the formation of secondary tungsten and/or chromium carbide crystals from the alloying elements of the prealloyed powder as well as thermal decomposition of the primary wear resistant particles during application.

The present invention further encompasses a composite article comprising a metallic substrate having metallurgically bonded to at least a portion of the surface thereof a ductile wear and corrosion resistant coating produced by the Plasma Transferred Arc technique of the powder composition previously described. The wear resistant layer is preferably applied in a plurality of successive coatings to a thickness as great as 0.125 inch or greater as may be desired.

Additional benefits and advantages of the present invention will become apparent upon a reading of the description of the preferred embodiments taken in conjunction with the accompanying drawing.

DESCRIPTION OF THE PREFERRED EMBODIMENTS

Figure 1:
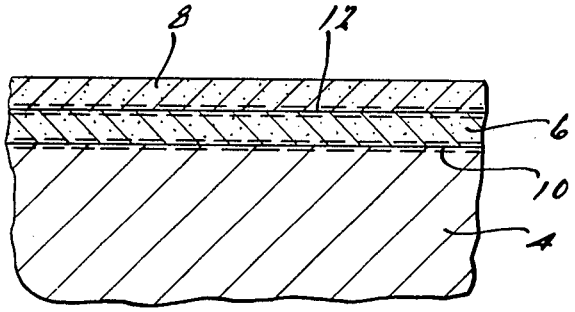
FIG. 1 is a fragmentary magnified cross sectional view of a substrate having a dual wear resistant coating on the surface thereof.

In accordance with the composition aspects of the present invention, a particulated mixture in the form of a prealloyed nickel-chromium-tungsten base alloy and primary wear resistant particles is prepared of a controlled particle size such as a Plasma Transferred Arc (PTA) grade powder. The primary wear resistant particles can comprise from about 15% up to about 60% by weight of the powder mixture, and preferably from about 25% to about 50% by weight.

The prealloyed powder is of a controlled composition and particle size and contains as its essential ingredients the elements in the amounts as listed in Table 1.

TABLE 1

| Element | Broad, %/wt. | Preferred, %/wt. | Nominal, %/wt. |
|---|---|---|---|
| Carbon | 0.5–1.7 | 0.9–1.3 | 1.1 |
| Chromium | 22.0–36.0 | 27.0–31.0 | 29.0 |
| Boron | 0.5–2.0 | 1.0–1.5 | 1.3 |
| Silicon | 1.0–2.8 | 1.5–2.25 | 1.95 |
| Iron | 5.0 max. | 3.0 max. | 2.0 max. |
| Tungsten | 3.0–14.0 | 6.0–9.0 | 7.5 |
| Cobalt | 2.0 max. | 0.2 max. | 0.2 max. |
| Others | 2.0 max. | 0.5 max. | 0.5 max. |
| Nickel | Balance | Balance | Balance |

The concentration of the carbon in the prealloyed powder is controlled within the ranges specified in Table 1 in that amounts less than about 0.5% by weight are undesirable because of insufficient secondary carbide formation while concentrations above about 1.7% by weight are undesirable because the matrix tends to become too brittle. The concentration of chromium is controlled within the ranges specified in that amounts above about 36% are undesirable because of loss of desirable fusing characteristics while amounts less than about 22% are undesirable because of loss of matrix ductility. The boron concentration is controlled within the range specified since that amounts greater than about 2% are undesirable because the alloy matrix becomes too hard whereas amounts less than about 0.5% are undesirable because the alloy matrix tends to become too soft. The range of silicon in the prealloyed powder is controlled within the ranges specified in that amounts above about 2.8% are undesirable because of excessive brittleness while concentrations below about 1% are undesirable because of loss of hardness.

The concentration of iron is controlled at a maximum of about 5% by weight in that amounts above this concentration result in decreased corrosion resistance. The concentration of tungsten is controlled within the range specified in that amounts above about 14% results in too high a melting point while concentrations below about 3% are undesirable because of insufficient quantity of tungsten available for secondary tungsten carbide formation. Cobalt can be tolerated as an impurity in amounts up to about 2% by weight and amounts above this magnitude are undesirable because the presence of such higher amounts of cobalt interfers with the formation of desirable secondary carbides during reaction and cooling of the weld pool. Other conventional and residual impurities may generally be present in amounts up to about 2% maximum and conventionally comprise copper, molybdenum, manganese and the like. The balance of the prealloyed powder consists essentially of nickel.

The prealloyed nickel-chromium-tungsten powder is of PTA grade and may conventionally range in particle size from about 80 up to about 325 mesh (ASTM-B 214) and preferably from about 100 to about 270 mesh. The particle configuration of the prealloyed powder is not critical although spherical-shaped particles are preferred.

The primary wear resistant particles of the particulated mixture may comprise any hard temperature resistant wear resistant substance such as tungsten carbide, chromium boride, chromium carbide, titanium carbide, and the like of which tungsten carbide itself comprises the preferred material. The primary wear resistant particles are also of a PTA grade in particle size and conventionally can range from about 80 up to about 325 mesh and preferably from about 100 to about 270 mesh. Particle shape is not critical although tungsten carbide particles are generally available from crushing operations and are of a shiny, angular irregular configuration.

The powder mixture comprising the prealloyed powder particles and primary wear resistant particles are mechanically blended within the appropriate proportions to form a substantially uniform mixture. The resultant mixture is thereafter applied, preferably employing the well-known Plasma Transferred Arc technique to a metallic substrate in which the powder mixture is introduced into an electric ion plasma arc at a temperature of at least about 15,000° F. during the application to effect a melting of the prealloyed powder particles and interalloying of the primary wear resistant particles with the alloy of the substrate. Alternative techniques can be employed which provide temperatures sufficient to melt the prealloyed particles and further provide an inert gas shield to avoid oxidation and inclusion of harmful gases during the application process.

Such alternative application techniques include conventional plasma arc as well as conventional thermal spray equipmemt which have the capacity of melting the prealloyed power particles to a temperature of at least about 100° F. above their nominal melting point of about 2,250° F. Inasmuch as the desirable and novel characteristics of the corrosion and wear resistant coating of the present invention resides in the formation of significant quantities of secondary tungsten carbide and/or chromium carbide crystals, the specific application technique employed must provide a sufficient time-temperature relationship to enable the formation of a sufficient quantity of such secondary carbide crystals. When the prealloyed particles are furnace fused at relatively low temperatures above their melting point, the molten weld pool must be maintained in the molten state for an appreciable period of time, such as, for example, about one hour to provide for such reaction and formation of secondary carbide crystals. On the other hand, as the temperature of the prealloyed powder particles is increased, such as to temperatures up to about 7,000° F. in accordance with the Plasma Transferred Arc technique, only relatively short time periods are required such as the time necessary to effect a normal solidification of the molten weld pool to achieve the requisite secondary carbide crystal formation. It will be apparent from the foregoing, that satisfactory application of the powder mixture can be achieved at a temperature above the melting point of the prealloyed particles such as, a temperature of at least about 2,350° F. up to a temperature of about 7,000° F. with corresponding adjustments in time at temperature to achieve the desired formation of secondary carbide crystals in the solidified layer. Of the several techniques available, the Plasma Transferred Arc system constitutes the preferred technique in which the arc is adjusted to a temperature generally ranging from about 15,000° F. up to about 25,000° F. through which the powder mixture is transferred effecting a heating thereof to the desired temperature.

Plasma Transferred Arc systems and apparatuses are well known in the art and essentially utilize a tungsten arc as the energy source with an inert gas such as argon transporting the metal powder particles providing a shield both of the molten weld pool as well as the adjacent base metal during application. In view of the high temperatures attained, some melting of the base metal occurs and a metallurgical interdiffusion bond is formed between the overlay coating and substrate.

While a variety of metal substrates can be coated in accordance with the present invention, the coating composition and process of the present invention is particularly suited for SAE 4140 and SAE 4130 alloy steels as well as 400 series martensitic and 300 series austenitic stainless steels. It is generally preferred to apply the coating in multiple passes such as two passes thereby producing a double coating layer metallurgically bonded to the substrate. The second layer includes only a minimal quantity of elements of which the base metal is comprised by diffusion and therefore provides for a coating having a hardness as measured on the Rockwell C scale of about 56. Because of the relatively high viscosity of the molten weld pool, the coating layer as applied can be relatively thick such as about 0.0625 inch per pass and can be built up through multiple passes up to about 0.125 inch or greater as desired. The relatively high viscosity of the weld pool further inhibits settling or segregation of the primary wear resistant particles during solidification of the coating thereby assuring homogeneity of the wear resistant layer.

Referring now in detail to the drawing, a composite article is illustrated in FIG. 1 comprising a metallic substrate 4 having a first wear resistant layer 6 on the surface thereof and a second wear resistant layer 8 over the first layer. The first layer is metallurgically bonded to the surface of the substrate by a diffusion bond 10 as schematically shown in FIG. 1 while the second layer 8 is similarly metallurgically bonded to the outer face of the first layer 6 by a diffusion bond indicated at 12.

Figure 2:
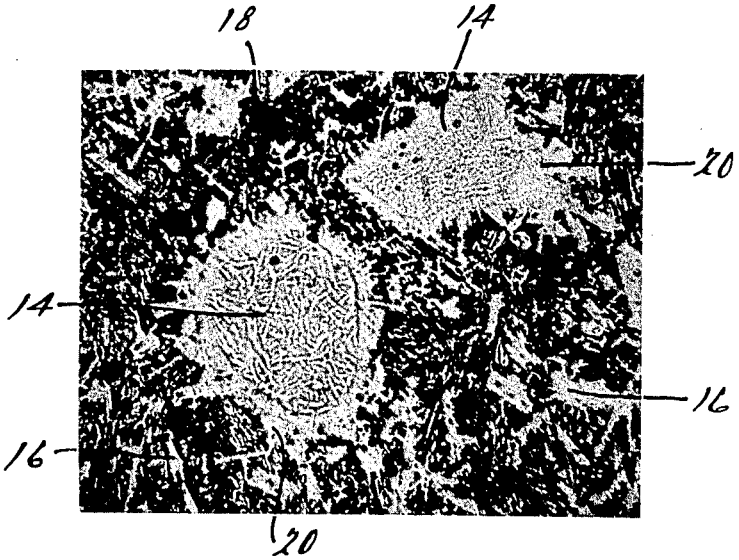
FIG. 2 is a photomicrograph taken at a magnification of 480× of the wear resistant coating of the present invention illustrating the uniform distribution of the primary wear resistant particles and secondary carbide crystals through a nickel-chromium-tungsten base alloy matrix.

A photomicrograph taken at a magnification of 480× of the surface of the outer layer 8 of FIG. 1 is illustrated in FIG. 2 showing the uniformity of the distribution of primary and secondary carbide crystals through the alloy matrix. As seen in FIG. 2, primary wear resistant particles such as tungsten carbide indicated at 14 are uniformly distributed and are surrounded by secondary chromium and/or tungsten carbide crystals indicated at 16 of a smaller size uniformly distributed through a nickel-chromium-tungsten alloy matrix comprising the dark colored portions of the photomicrograph and indicated at 18. An interalloying of the primary wear resistant particles with the alloy elements of the prealloyed powder evidenced by the formation of secondary chromium carbide and/or tungsten carbide crystals surrounding the primary wear resistant particles 14 is indicated at 20. The unique microstructure of the solidified layer attains benefits unexpected and heretofore not obtainable in accordance with prior art techniques.

In order to further illustrate the present invention, the following example is provided. It will be understood that the example is provided for illustrative purposes and is not intended to be limiting of the scope of the present invention as herein described and as set forth in the subjoined claims.

EXAMPLE

A test bar composed of SAE 1020 steel of a length of six inches, a width of one inch and a thickness of 0.5 inch was degreased and descaled. A powder mixture was prepared by providing a cast and crushed tungsten carbide powder having a particle size ranging from −325 up to 80 mesh with the particle size distribution being 88% of a size less than 100 mesh. A prealloyed powder was provided of the same particle size range and distribution as the primary wear resistant particles nominally containing 1.1% by weight carbon, 29% by weight chromium, 1.3% by weight boron, 1.95% by weight silicon, 2% max. iron, 7.5% tungsten, less than 0.5% by weight conventional residuals and impurities with the balance consisting essentially of nickel. A power mixture was prepared employing 70% by weight of the prealloyed power and 30% by weight of the primary tungsten carbide wear resistant particles which were mechanically mixed to form a uniform mixture.

The powder mixture was placed in the powder hopoer of a Plasma Transferred Arc apparatus available from Linde Corporation provided with an argon shielding gas. The powder mixture was introduced into the electric ion plasma arc of the PTA torch at a temperature above about 15,000° F. and heated to a temperature above the melting point of the prealloyed powder particles (nominal melting point of about 2,250° F.) to a temperature estimated as ranging from about 6,000° F. to about 7,000° F.

A first pass of the apparatus was made to apply a first layer at a thickness of about 0.075 inch at a linear traverse speed of about one inch per ten seconds by which a layer of about one inch wide was applied to the test bar. After a short period of cooling of about three to about five minutes, a second pass was made to apply a second layer of about 0.075 inch over the first layer and under the same application conditions.

Upon inspection of the composite layer it was observed that a shallow dilution of the base metal and the lower stratum of the first layer at the interface occurred of a thickness of about 0.025 inch. The balance of the wear resistant composite coating was substantially dilution free. Upon further inspection, the micro structure of the second layer generally corresponded to that shown in FIG. 2 of the drawing.

While it will be apparent that the preferred embodiments of the invention disclosed are well calculated to fulfill the objects above stated, it will be appreciated that the invention is susceptible to modification, variation and change without departing from the proper scope of fair meaning of the subjoined claims.

What is claimed is:

1. A method of applying a wear and corrosion resistant alloy layer on a metallic substrate which comprises the steps of forming a powder mixture containing about 40% to about 85% by weight of prealloyed particles and about 60% to about 15% by weight of primary wear resistant particles, said prealloyed particles containing from about 0.5% to about 1.7% by weight carbon, about 22% to about 36% by weight chromium, about 0.5% to about 2% by weight boron, about 1% to about 2.8% by weight silicon, up to a maximum of about 5% by weight iron, about 3% to about 14% by weight tungsten, up to a maximum of about 2% by weight cobalt, up to a maximum of about 2% by weight of conventional residuals and impurities and the balance comprising nickel; heating said powder mixture to a temperature of at least about 2,350° F. and effecting a melting of said prealloyed particles and applying the heated said powder mixture in the presence of an inert gas atmosphere to a metallic substrate in the form of a layer and thereafter cooling said layer.

2. The method as described in claim 1 in which the step of heating and applying said powder mixture is performed by a plasma transferred arc system.

3. The method as described in claim 1 including the further step of applying a plurality of said layer in overlying relationship on the metallic substrate.

4. The method as defined in claim 1 in which said prealloyed powder particles contain about 0.9% to about 1.3% by weight carbon, about 27% to about 31% by weight chromium, about 1% to about 1.5% by weight boron, about 1.5% to about 2.25% by weight silicon, up to a maximum of about 3% by weight iron, about 6% to about 9% by weight tungsten, up to a maximum of about 0.2% by weight cobalt, up to a maximum of about 0.5% by weight of conventional residuals and impurities and the balance comprising nickel.

5. The method as defined in claim 1 in which said prealloyed powder particles contain about 1.1% by weight carbon, about 29% by weight chromium, about 1.3% by weight boron, about 1.95% by weight silicon, up to a maximum of about 2% by weight iron, about 7.5% by weight tungsten, up to a maximum of about 0.2% by weight cobalt, up to a maximum of about 0.5% by weight of conventional residuals and impurities and the balance comprising nickel.

6. The method as defined in claim 1 in which said primary wear resistant particles are selected from the group consisting of tungsten carbide, chromium boride, chromium carbide, titanium carbide and mixtures thereof.

7. The method as described in claim 1 in which the step of heating said powder mixture is performed to a temperature up to about 7,000° F.

8. The method as described in claim 1 in which the metallic substrate is selected from the group consisting of SAE 4140 steels, SAE 4130 steels, 400 martensitic and 300 austenitic stainless steels.

9. The method as described in claim 1 in which said primary wear resistant particles comprise tungsten carbide.

10. The method as described in claim 1 in which the particles of said powder mixture are of a size ranging from about 80 up to about 325 mesh.

11. The method as described in claim 1 in which the particles of said powder mixture are of a size ranging from about 100 to about 270 mesh.

12. The method as described in claim 1 in which the step of applying the heated said particles is performed to produce a layer up to about 0.0625 inch thick.

13. The method as described in claim 1 in which the step of applying the heated said particles is performed to apply a plurality of successive overlying layers of a combined thickness up to about 0.125 inch or greater.

14. A composite article having a wear and corrosive resistant layer on at least a portion of the surface thereof produced by the method of claim 1 in which said layer is characterized by a nickel-chromium-tungsten base alloy matrix metallurgically bonded to the substrate having substantially uniformly distributed therethrough said primary wear resistant particles in combination with secondary chromium carbide and/or tungsten carbide crystals.

15. A powder mixture adapted for application by the Plasma Transferred Arc technique to a metallic substrate for forming a metallurgically bonded wear and corrosive resistant layer comprising a nickel-chromium-tungsten base alloy matrix having substantially uniformly dispersed therethrough primary wear resistant particles in combination with secondary chromium carbide and/or tungsten carbide crystals comprising a mixture containing about 40% to about 85% by weight of prealloyed particles and about 60% to about 15% by weight primary wear resistant particles, said prealloyed particles containing from about 0.5% to about 1.7% by weight carbon, about 22% to about 36% by weight chromium, about 0.5% to about 2% by weight boron, about 1% to about 2.8% by weight silicon, up to a maximum of about 5% by weight iron, about 3% to about 14% by weight tungsten, up to a maximum of about 2% by weight cobalt, up to a maximum of about 2% by weight of conventional residuals and impurities and the balance comprising nickel.

* * * * *